US011644239B2

(12) United States Patent
Ebner et al.

(10) Patent No.: US 11,644,239 B2
(45) Date of Patent: May 9, 2023

(54) ARRANGEMENT HAVING PLURAL TEMPERATURE-CONTROL STATIONS FOR HEAT TREATING COMPONENT PARTS, AND THEIR HANDLING

(71) Applicant: EBNER INDUSTRIEOFENBAU GMBH, Leonding (AT)

(72) Inventors: Robert Ebner, Leonding (AT); Günter Grillberger, Ottensheim (AT); Peter Ladner, Hellmonsödt (AT); Martin Lauber, Linz (AT)

(73) Assignee: Ebner Industrieofenbau GmbH, Leonding (AT)

( * ) Notice: Subject to any disclaimer, the term of this patent is extended or adjusted under 35 U.S.C. 154(b) by 113 days.

(21) Appl. No.: 16/965,280

(22) PCT Filed: Jan. 31, 2019

(86) PCT No.: PCT/EP2019/052343
§ 371 (c)(1),
(2) Date: Jul. 27, 2020

(87) PCT Pub. No.: WO2019/158365
PCT Pub. Date: Aug. 22, 2019

(65) Prior Publication Data

US 2021/0071955 A1 Mar. 11, 2021

(30) Foreign Application Priority Data

Feb. 13, 2018 (DE) ..... 10 2018 103 145.9

(51) Int. Cl.
*F27B 9/02* (2006.01)
*F27B 9/24* (2006.01)
(Continued)

(52) U.S. Cl.
CPC ..... *F27B 9/028* (2013.01); *F27B 9/2407* (2013.01); *C21D 9/667* (2013.01); *C21D 9/675* (2013.01); *F27B 11/00* (2013.01)

(58) Field of Classification Search
CPC ..... C21D 9/667; C21D 9/675; F27B 11/00; F27B 9/028; F27B 9/2407
(Continued)

(56) References Cited

U.S. PATENT DOCUMENTS 3,370,839 A * 2/1968 Wilson et al. ..... C21D 9/54 432/87
3,866,891 A 2/1975 Kalbfleish
(Continued)

FOREIGN PATENT DOCUMENTS

CN 109136525 A 1/2019
CN 208917268 U 5/2019
(Continued)

OTHER PUBLICATIONS

International Search Report of corresponding PCT/EP2019/052343, dated Mar. 26, 2019, with English translation, 9 pages.
(Continued)

*Primary Examiner* — Scott R Kastler
*Assistant Examiner* — Michael Aboagye
(74) *Attorney, Agent, or Firm* — Lewis Roca Rothgerber Christie LLP

(57) ABSTRACT

An arrangement for heat treating component parts. The arrangement has a first temperature control station for heat treating component parts and a second temperature control station for heat treating component parts, wherein the first temperature control station and the second temperature control station each have a temperature control device, on each of which a functional device is placeable. The functional device is a charging device for carrying component
(Continued)

parts to be temperature-controlled or a device of the temperature control device. The arrangement further has a charging station, on which the functional device is placeable, and a handling system for handling the functional device, wherein the handling system is configured to convey the functional device between the charging station, the first temperature control station and the second temperature control station.

20 Claims, 6 Drawing Sheets

(51) Int. Cl.
*C21D 9/667* (2006.01)
*C21D 9/675* (2006.01)
*F27B 11/00* (2006.01)

(58) Field of Classification Search
USPC ..... 266/249, 256, 263, 248; 432/49, 112, 432/118, 239; 219/394, 391, 521, 525
See application file for complete search history.

(56) References Cited

U.S. PATENT DOCUMENTS 5,143,558 A * 9/1992 Smith ..... C21D 9/0018 266/259
5,306,359 A * 4/1994 Eppeland ..... F27B 9/40 148/698
5,402,994 A 4/1995 Egger
5,624,255 A * 4/1997 Hisada ..... C21D 9/0018 432/198
6,318,571 B1 * 11/2001 Maumus ..... F27D 5/0006 211/194
2005/0035108 A1 2/2005 Eisenhammer et al.
2012/0264074 A1 10/2012 Gockel et al.
2014/0224388 A1 8/2014 Frost et al.
2017/0370648 A1 12/2017 Katsumata et al.

FOREIGN PATENT DOCUMENTS

DE 21 56 306 B2 3/1975
DE 4303686 A1 4/1994
DE 198 26 949 A1 12/1999
DE 69612655 T2 8/2001
DE 10 2005 041 233 A1 3/2007
DE 10 2013 101 489 B3 6/2014
EP 0785402 A1 7/1997
EP 1 618 596 B1 1/2006
EP 2 511 639 A1 10/2012
FR 1 483 444 A 6/1967
FR 2 537 260 A1 6/1984
GB 878743 A 10/1961

OTHER PUBLICATIONS

Witten Opinion of corresponding PCT/EP2019/052343, dated Mar. 26, 2019, 8 pages.
Office action issued in corresponding Austria Application No. A 9004/2019, dated Apr. 1, 2021, 4 pages.

* cited by examiner

ARRANGEMENT HAVING PLURAL TEMPERATURE-CONTROL STATIONS FOR HEAT TREATING COMPONENT PARTS, AND THEIR HANDLING

REFERENCE TO RELATED APPLICATIONS

The present application is a national phase application derived from the international patent application no. PCT/EP2019/052343, filed Jan. 31, 2019, which in turn claims the benefits of the filing dates of the German patent application no. DE 10 2018 103 145.9, filed Feb. 13, 2018, all of which are incorporated herein by reference in their entireties.

TECHNICAL FIELD

The present invention relates to an arrangement having plural temperature control stations for heat treating component parts, and a method for heat treating component parts in plural temperature control stations.

BACKGROUND OF THE INVENTION

In stationary industrial furnaces, such as hood-type furnaces, a base of the hood-type furnace is first loaded with a batch (or charge) of component parts to be heated. Subsequently, an appropriate furnace hood is placed over the batch so that the furnace hood together with the base forms an annealing chamber. The annealing chamber can then be set to an appropriate temperature so that the charge can be heat treated.

Plural different furnace hoods (e.g. protective hood, warmness hood, heating hood, cooling hood etc.) are placeable on the base. Thus, for example, a protective hood can first seal the annealing chamber, for example to create a protective gas atmosphere in in the annealing chamber. Furthermore, a furnace hood can be configured as a cooling hood in order to cool the batch.

Different furnace hoods can be put over the protective hood, so that, for example, interspaces are created between two furnace hoods, into which a certain heat medium or cooling medium can be introduced.

The furnace hoods are lifted by a crane and lowered onto the base or at their storage place. The furnace hoods must be placed on the base extremely precisely. Furthermore, the furnace hoods must be centered and aligned with each other. This requires a high degree of accuracy and results in that the placing of the furnace hoods needs a high expenditure of time.

During the placing of the batch on the base and during the superimposition of the furnace hoods no further batch can be heat treated. Such a long set-up time reduces the effectiveness of the hood-type furnace.

The component parts to be heat-treated are fixed, for example, to so-called crown supports (or headstocks). The crown supports are embodied in a columnar fashion, for example. So-called coils (metal strip coils or wire coils), for example, can be slipped over the crown supports as the component part to be heated. A plurality of crown supports can thus be placed on the base of the hood-type furnace by a hand-operated crane and together form a batch. During the placing of the individual crown supports, the hood-type furnace cannot be operated, so that a long set-up time is required.

PRESENTATION OF THE INVENTION

There may be a need to increase the efficiency of a stationary furnace for metal component parts.

This need is satisfied by an arrangement for heat treating component parts as well as by a method for heat treating component parts according to the independent claims.

According to a first aspect of the present invention, therein is described an arrangement for heat treating component parts, in particular of coiled metal strips or metal wires (so-called coils). The arrangement has a first temperature control station for heat treating component parts and a second temperature control station for heat treating component parts, wherein the first temperature control station and the second temperature control station each have a temperature control device, onto each of which a functional device is placeable. The functional device is a charging device (or device for arranging in batches) for carrying component parts to be temperature-controlled, or a device of the temperature control device, such as for example a guide cylinder or a furnace hood of a hood-type furnace. The arrangement further has a charging station, on which the functional device is placeable, and a handling system for handling the functional device, wherein the handling system is configured to convey, in particular autonomously and automatically, the functional device between the charging station, the first temperature control station and the second temperature control station. The first temperature control station, the second temperature control station and the charging station are arranged one after the other along an apposition.

According to another aspect of the present invention, a method for heat treating component parts with the arrangement described above is provided.

The temperature control stations may describe a location and/or a station, at which a temperature control device may be provided in order to temperature-control (or temper) the component parts, for example in particular according to the type of a hood-type furnace or according to the type of other stationary or continuous furnaces. The temperature control stations each may have a temperature control device, in which the component parts to be temperature-controlled may be placed, for example individually or as a batch in a charging device. The charging device may represent a crown support (or headstock), a basket, a storage container, or a carrier and/or support frame. Furthermore, a corresponding furnace base of a hood-type furnace may be placeable in the corresponding temperature control stations as a temperature control device, wherein corresponding furnace hoods of temperature control devices may be placeable on the furnace base, which together with the furnace base may isolate the component parts from the environment. Furthermore, closed furnace chambers of temperature control devices may be present in the corresponding temperature control stations.

A temperature control device may describe a device, which may temperature-control component parts to be temperature-controlled (or tempered), i.e. may heat or cool the component parts. In particular, the temperature control devices described herein may represent a stationary or continuous furnace, such as for example a stationary hood-type furnace or a continuous through-type furnace. For example, the temperature control device may form a chamber furnace or an overhead furnace. The temperature control device may also represent a cooling device, such as for example an immersion basin or a through-type cooling device. In the case of continuous temperature control devices, such as for example a through-type cooling device or a through-type furnace, at least the inlet for the delivery or reception of the component parts may be located in the corresponding temperature control station. The handling system may accordingly deliver or receive the component parts at the inlet. The temperature control stations may each have different types of the above-mentioned temperature control devices independently of each other.

In the temperature control unit described, various component parts, in particular metallic component parts may be heat treated with a predetermined temperature control curve. The component parts may consist of metal strips or metal wires, for example. The metal strips or metal wires may be coiled up in the form of a coil in order to thus achieve a better stacking. A unit of component parts, which may be temperature-controllable in the temperature-control device in one temperature-control process, may be called a batch (or charge). The component parts may also be a piece goods or bulk material. The component parts may also represent finished casting parts, precision forging parts or sintered parts. Furthermore, a component part may be a semi-finished product.

In the temperature control stations the component parts may be temperature-controlled, i.e. heated or actively cooled. Furthermore, the component parts may can also be kept at a defined temperature for a predetermined period of time in the temperature control station.

In the charging stations, the component parts may be prepared and charged (or arranged in batches) accordingly for the temperature control stations. For example, support elements and carrier elements of a charging device may be placeable on a charging station and equipped with the component parts. The charging device may have a support element as its base body. The component parts may be attachable to a carrier element, which may be configured as a carrier column. The component parts may, for example, be placed over the carrier column. The carrier element may be detachably attached to the base body. Furthermore, a handling system may be coupled, via a transport coupling, to the support element and/or base body or the carrier column for the transport of the charging device. The charging device may also be embodied as a basket, as a storage container or as a carrier and/or support frame for the component parts.

From the charging station, for example, the fastening device of the handling system may grip the charging device and feed it to a corresponding temperature control station. At a charging station, a movable base body of the charging device may be placeable, on which a plurality of charged component parts (or component parts arranged in batches) may already be placed, in particular on corresponding carrier elements and/or support elements. Thus, a base body equipped with a plurality of carrier elements may be moved to the charging station, whereby thereafter the handling system may receive the base body and/or the plurality of support elements and may move then on to the corresponding temperature control stations.

The handling system may be embodied as a (partially) autonomous system and can automatically, i.e. without manual control interventions, operate the temperature control and charging stations. For this purpose, the handling system may be equipped, for example, with motion sensors, distance sensors and position sensors in order to enable a precise control. Furthermore, the handling system may be rail-guided, for example, as described below.

A functional device may describe, for example, a charging device, in which a plurality of component parts may be prepared in order to be further transported to the other stations by the handling system. Furthermore, a functional device may also be understood to be, for example, a guide cylinder or a furnace hood, which may, for example, be placeable on a base of the temperature control device at a temperature control station. In a hood-type furnace, for example, plural different furnace hoods may be placeable on top of each other in a nested arrangement. For example, a furnace hood with a larger diameter may be placed over a furnace hood with a smaller diameter so that the smaller furnace hood may be located in the larger furnace hood. The innermost furnace hood may act as a protective hood, for example, so that a protective gas atmosphere may be formed in an inner annealing chamber. Another furnace hood, such as a warmness hood and/or heating hood or a cooling hood, may be placeable over the protective hood. A furnace hood can have, for example, a height between 4 m and 8 m (meters). For example, a furnace hood may have, for example, a diameter between 4 m and 6 m.

According to the invention, the temperature control stations, the charging stations and, for example, the storage stations described below may be arranged one after the other along a linear or circular apposition (or arrangement). The handling system may operate the individual stations along this apposition and may remove or feed component parts from or into them as required. The temperature control stations, the charging stations and, for example, the storage stations described below may therefore not be arranged parallel to each other, so that the handling system may move, for example, between the stations, but may be arranged one after the other along an apposition and/or arrangement line. The handling system may be movable and/or rotatable (or swivellable) along the apposition.

With the above described arrangement according to the invention, an efficient temperature-control system for component parts may be provided in plural temperature control devices at corresponding temperature control stations, e.g. according to the type of the hood furnace principle. Plural temperature control stations and one charging station may be operated (or served) with component parts by the handling system. For example, the handling system may convey a batch of component parts to a temperature control station, while another batch of component parts may already be being prepared on the charging station. While the one batch of component parts may be being temperature-controlled in a temperature control station, temperature-controlled component parts may be conveyed on the other temperature control station or be fed to this other temperature control station. In addition, it may be possible that the handling system may also lift and convey the furnace hoods of the respective temperature control stations to ensure the access to the temperature-controlled component parts and/or the base of the temperature control stations. By the handling system, which may operate the temperature control stations as well as the charging stations, simultaneous process sections, such as for example charging, heating and/or cooling may be carried out.

Various component parts, in particular metallic component parts, may be heat-treated with a predetermined temperature-control sequence in the described temperature control device and/or the hood furnace. The component parts may consist, for example, of metal strips or metal wires. The metal strips or metal wires may be coiled up in the form of a coil in order to thus achieve a better stacking.

According to a further exemplary embodiment, the arrangement may have at least one further, in particular four further, temperature control stations for heat treating component parts, wherein the further temperature control station may have a temperature control device, on which a functional device may be placeable. The handling system may be configured to convey the functional device between the at least one charging station and the temperature control stations. With the described embodiment example, it is emphasized that a plurality of temperature control stations may be operated by one and the same handling system.

According to a further exemplary embodiment, the arrangement may have at least one further charging station, on which the functional device may be placeable. The handling system may be configured to transport the functional device between the charging stations and the temperature control stations. For example, at one charging station, the carrier elements may be loaded with component parts, while at the other charging station the handling system may place a batch with already temperature-controlled component parts. Subsequently, the handling system may grip the batch, which may have been equipped with component parts, which may not yet have been temperature-controlled, and may feed it to a free temperature control station, while the already temperature-controlled component parts may be further processed at the other charging station.

According to a further exemplary embodiment, the arrangement may have a storage station at which the handling system and/or the functional device may be storable, wherein the handling system may be configured to convey the functional device between the storage station, the at least one charging station and the temperature control stations. The storage station may thus form a placeholder between the temperature control stations and the charging stations. For example, a batch of already temperature-controlled component parts may be stored at the storage station while the handling system may already be conveying other functional units, such as another batch of component parts to be temperature-controlled or a furnace hood. Furthermore, furnace hoods of a temperature control station may be stored in order to thereby enable the handling and the access to component parts in this temperature control station.

According to a further exemplary embodiment, the at least one charging station and the temperature control stations may be arranged side by side along a linear apposition (or linear arrangement), wherein the handling system may be configured to be movable parallel to the linear apposition. A linear apposition may be understood, for example, to mean that the centers and/or the center points of the respective stations (temperature control stations, charging stations and, if appropriate, storage station) may be arranged in a row spaced apart from each other along an imaginary line.

Thus, a linear apposition may be provided, along which the handling system may be moved. In this arrangement, it may be possible, for example, to arrange plural above-described arrangements with a linear embodiment parallel to each other. Thus, for example, the usage of space in a hall may be used optimally.

According to a further exemplary embodiment, the at least one charging station and the temperature control stations may be arranged side by side along a circular apposition, wherein the handling system may be located in the center of the circular line. A circular apposition (or circular arrangement) may be understood to mean, for example, that the centers and/or the center points of the respective stations (temperature control stations, charging stations and, if appropriate, storage station) may be arranged in a row along an imaginary circle spaced apart from each other.

With a circular apposition, the stations may be placed closely around the handling system. The handling system may thus reach each station over a short distance without having to perform long translatory movements. If the handling system is placed in the center and/or center point of the circular apposition, the handling system may rotate and adjust itself to a desired station due to the rotating of its orientation. Subsequently, the handling system, for example with its base frame and/or the gripper frame, may be moved out of the center in a translatory motion in the direction of the respective station in order to place or remove the corresponding functional devices, such as the charged component parts or the furnace hoods.

With a ring or ring segment arrangement according to the embodiment example described above, short transfer paths and thus short charging times may be achieved.

According to a further exemplary embodiment, the arrangement may have a rotary table (or turntable), which may be arranged on a floor in the center of the circular apposition. The handling system in the center on the rotary table may be placed in such a way that the handling system may be rotatable in its orientation by turning the rotary table. For example, guide rails may be formed on the rotary table into which the rail guide elements of the base frame may be coupled. If the rotary table is in a desired rotational position, the guide rails of the rotary table may be aligned with the guide rails in the floor so that the base frame may be moved along the guide rails of the rotary table and the guide rails in the floor, which may lead in the direction towards the desired station.

According to a further exemplary embodiment, a first group of the at least one charging station and the temperature control stations may be arranged side by side along the circular apposition, wherein a second group of the temperature control stations may be arranged side by side along a further circular apposition. The circular apposition and the further circular apposition may overlap, wherein the handling system may be arranged in such a way that the handling system may be movable, in particular linearly, between the center of the circular apposition and a further center of the further circular apposition.

The circular apposition as well as the further circular apposition may overlap each other, so to speak, in an area, wherein the circumference of the overlapping appositions may give the shape of an 8. Both circular appositions each may have spaced centers, from which the handling system may serve the respective group of stations. In the exemplary embodiment, the handling system may be moved between the centers in order to reach all stations. In a further exemplary embodiment, a respective handling system may be provided in each center.

In a further exemplary embodiment, the arrangement may have a further rotary table (or further turntable), which may be arranged on a floor in the further center of the further circular apposition, wherein the handling system may be placeable in the further center on the rotary table in such a way that the handling system may be rotatable in its orientation by rotating the further rotary table.

According to a further exemplary embodiment, the arrangement may have a control unit, which may be coupled to the handling system, the temperature control stations and the at least one charging station, wherein the control unit may be configured to automatically (autonomously) control the handling system, the temperature control stations and the at least one charging station. The control unit may have, for example, a microprocessor, which may be adapted to execute corresponding control programs for controlling the handling system and the temperature control devices on the temperature control stations. In particular, the arrangement may be operated automatically by the control unit so that, in particular based on the control programs, the handling system may be moved, and the temperature control devices at the temperature control stations may be operated automatically.

In the following, further exemplary embodiments of the handling system explained above for carrying component parts to be temperature-controlled are described.

According to a further exemplary embodiment, the handling system may have a transport device. The transport device may have a base frame, which may be transportable along a floor, and a fastening device, which may be coupled to the base frame. The fastening device may be configured to selectively fasten the functional device to the base frame, wherein the base frame may be adapted such that the base frame is transportable for transporting the functional device between a set-up location, at which the functional device may be selectively fastenable to the base frame, and a temperature control location in the temperature control device.

According to a further exemplary embodiment, the handling system as described above may have a functional device. The functional device may consist, for example, of the charging device described above for carrying component parts to be temperature-controlled or a furnace hood.

According to a further exemplary embodiment, the base frame may be embodied along a base plane, wherein the fastening device may be movable perpendicular and/or parallel to the base plane. With the fastening device, in addition to the height adjustment, also a fine adjustment in a direction parallel to the base plane may be implemented, as the fastening device may also be movable parallel to the base plane.

According to a further exemplary embodiment, the transport device may have at least a first guide structure, which may be fixed to the base frame and extends (at least with a directional component) perpendicular to the base plane. The fixing device may have a first guide carriage, which may be movably coupled to the first guide structure. The first guide carriage may be selectively coupleable to the functional device.

The first guide structure may consist, for example, of one or more beams (or carriers, or girders) (steel beams), which may be fixed to the base frame. Furthermore, the first guide structure may also consist of a framework of beams. The beams may form, for example, simultaneously guide rails for the first guide carriage. For example, the first guide carriage may be movable along a column as a beam. Alternatively, two spaced beams may be provided, at which the first guide carriage is arranged movably.

For example, to put a furnace hood over another furnace hood or over the component parts, the guide carriages may be movable up to a height of 15 m to 20 m (meters). Accordingly, the guide structures may have a height of 15 m to 20 m or 25 m.

The guide carriage may be drivable, for example, mechanically by a chain drive, or electrically, for example by a servo motor.

According to a further exemplary embodiment, the first guide carriage may have a controllable fastening element, in particular a clamping jaw. The controllable fastening element may be adjustable into a release position, in which the functional device may be decoupled from the controllable fastening element, and into a clamping position, in which the functional device may be coupled to the controllable fastening element.

The controllable fastening elements may, for example, be movable clamping jaws or an operable gripping element in order to implement a selective coupling to the functional unit. Furthermore, the controllable fastening element may have an extendable fastening bolt. The fastening element may be arranged movably in translation or rotatable (or pivotable, or swivellable) between the release position and the clamping/fixing position. For this purpose, the functional unit may in particular have corresponding coupling areas, in which the controllable fastening element may engage. For example, a coupling area may have a fastening rail, a fastening sleeve, a fastening hook and/or a fastening eye, so that the controllable fastening element may selectively engage.

According to a further exemplary embodiment, the transport device may have at least a second guide structure, which may be fixed to the base frame and extends perpendicular to the base plane. The fixing device may have a second guide carriage, which may be movably coupled to the second guide structure. The second guide carriage may be selectively coupleable to the functional device, wherein the first guide carriage and the second guide carriage may be arranged in such a way that the guide carriages may be opposite to each other with respect to the functional device.

The second guide structure may be configured according to the first guide structure described above. Accordingly, the described further first guide carriages, second guide carriages and further second guide carriages may be configured according to the guide carriage described above.

Thus, the functional device may advantageously be fixed, in particular clamped, between the first guide carriage and the second guide carriage.

In a further exemplary embodiment, furthermore, a further third guide structure may, with a corresponding third guide carriage, also be fixed to the base body. In this way, plural fixing points with the functional device may be produced, and accordingly, a robust coupling may be achieved.

According to a further exemplary embodiment, the transport device may have a further fastening device, wherein the further fastening device may be movable perpendicular to the base plane. The fastening device and the further fastening device may thus be arranged one after the other along a direction perpendicular to the base plane. In particular, the fastening device and the further fastening device may be moved relative to each other.

According to a further exemplary embodiment, the further fastening device may have a further first guide carriage, which may be movably coupled to the first guide structure, wherein the further first guide carriage may be selectively coupleable to the functional device or to a further functional device.

According to a further exemplary embodiment, the further fastening device may have a further second guide carriage, which may be movably coupled to the second guide structure. The further second guide carriage may be selectively coupleable to the functional device or to the further functional device. The further first guide carriage and the further second guide carriage may be arranged in such a way that the further guide carriages may be opposite to each other with respect to the functional device.

According to a further exemplary embodiment, the handling system may have a further functional device, which may, for example, be configured as a furnace hood. The further functional device may be selectively coupleable to the further fastening device, wherein the functional device by the fastening device and the further functional device by the further fastening device may be movable relative to each other.

Thus, for example, a further furnace hood may be slipped onto the charging device for carrying component parts to be temperature-controlled or onto a first furnace hood as a functional device. Alternatively, a further hood may be withdrawn from the functional device by the further fastening device. With the handling system described, a complete charging unit may thus be assembled outside the temperature control device. At first, the batch may be conveyed into the temperature control station. Then the protective hood may be put on. It may also be possible to place the heating hood at the same time. When de-charging, the furnace hoods may be removed first before the charge may be lifted off. Due to the guidance of the furnace hood by the handling system, assembly devices, such as for example guide columns for centering the furnace hoods during crane-based assembly, may be dispensed with.

Because the first and second guide structure and their movable fastening device may form a rigid unit, the functional units may be positioned extremely accurately relative to each other. In conventional use of a crane for transporting functional units, the functional units may swing and/or sway on the crane rope, so that an exact alignment of the functional units relative to each other may be extremely difficult and time-consuming. By the rigid unit of the handling system described above, a centering of the furnace hoods and/or a relative alignment of the functional units relative to each other may be facilitated.

According to a further exemplary embodiment, the handling system may further have at least one coupling element, which may be configured to couple the functional device to the further functional device selectively to form a charging unit in such a way that the charging unit may be movable perpendicular to the base plane by the first fastening device or the second fastening device.

According to a further exemplary embodiment, the functional device may form a gripper unit, to which a component part may be selectively coupleable, wherein the gripper unit may be selectively attachable to the base frame by the fastening device.

According to a further exemplary embodiment, the gripper unit may have a gripper frame and a rod unit having plural rods (or bars), in particular mutually parallel rods. The rod unit may be configured movably relative to the gripper frame and/or together with the gripper frame (relative to the base frame) in such a way that the rods may be insertable into engagement openings of support elements, on which the component parts may be placeable in order to transport the support elements.

The gripper frame may have, for example, a U-shape consisting of two parallel beams, which may be connected to a common base beam. Inside the gripper frame, plural rods of the rod unit may extend from one side of the gripper frame in the direction towards the open side of the U-shaped gripper frame. The rods may be configured in such a way that they may be insertable into corresponding engagement openings of support elements of the charging device described above. In this respect, the engagement openings may form passage openings through the support elements.

The rod unit may be configured movably relative to the gripper frame, and may be moved, for example, in the direction of the support elements.

Furthermore, the rod unit together with the gripper frame may be configured movably relative to the base frame, which may be configured movably along the ground. Thus, the gripper frame with the rod unit may be moved relatively into and out of the base frame in order to grip the support elements, on which the component parts can be stored.

The gripper frame may be selectively coupled to the base frame. For example, a coupling device and/or a fastening device may be provided at the base frame, which may selectively couple the base frame in order to subsequently transport it.

After the insertion of the rods of the rod unit, the gripper frame or the base frame of the handling system may be raised or lowered in order to move the support elements along the carrier elements accordingly and/or to transport the support elements together with the component part to desired locations, such as for example the temperature control station or charging stations described below.

According to a further exemplary embodiment, the transport device may have roller elements on the base frame, by which the base frame may be movable along a floor. The roller elements may, for example, have a driven roller element so that the transport device may be driven.

According to a further exemplary embodiment, the transport device may have a rail guide element and a guide rail. The guide rail may be fixable on a floor, wherein the rail guiding element may be coupled to the base frame and may be coupleable to the guide rail in such a way that the base frame may be movable along the guide rail. The guide rails may, for example, be embedded or fixed in a floor, and may lead in a desired direction of travel of the transport device. The rail guide element may have, for example, a rubber wheel or a metal wheel, which may be detachably coupled to the guide rails and may be moved along the guide rails.

Alternatively or in addition to the guide rails, the arrangement may have, in a further exemplary embodiment, conveyor rollers on the floor, along which the handling system may be transported. A roller conveyor may thus be provided, on which the handling system may roll along between the stations. The conveyor rollers may at least partially be driven in order to actively move the handling system.

With the arrangement according to the invention, there may thus be provided a (partially) automated solution, in which plural component parts defined above, for example stacks of wire coils, may be supplied or removed simultaneously. In particular, the entire handling process of the component parts on the one hand and the equipment of the temperature control devices (e.g. of furnace hoods) on the other hand may be carried out by the innovative handling and charging equipment (i.e. the handling system), and thus, for example, may completely replace a crane. In particular, by the arrangement, travel distances of a charging device may be reduced due to the described arrangement of the stations.

The heat treatment of component parts, e.g. wire coils, may be carried out in the temperature control devices in the temperature control stations, which may be e.g. operable in the manner of hood-type furnaces, chamber furnaces or continuous furnaces. In the case of a hood-type furnace as temperature control device, coils of wire as component parts may be stacked in plural stacks on a furnace base. To avoid damage to the wire coils, this may be done in plural tiers from a certain stacking height onwards. In further process steps, protective, cooling and heating hoods may then be placed over the stacked coils in an appropriate sequence. The charging, i.e. the supplying to and removing of wire coils from the furnace, for example, may take ~10% of the total process time. The entire handling of the wire coils as well as the different hoods may often be carried out by large cranes. In order to reduce the charging times, the handling system and the arrangement according to the invention are described. In an exemplary embodiment, the handling system may function as a rail-guided lift truck so that a base frame of the handling system may be configured movably on guide rails on the floor. The handling system may, on the one hand, de-charge the entire annealed charge from the annealing base in one work step, and, in a further work step, may load the furnace (temperature control station) with the entire new charge, and may handle (or effect) the entire hood handling (cooling hood including protective hood and/or heating hood). The individual work steps may be to be carried out using different attachments and/or set-on devices (e.g. the gripper unit described or the guide structures), which may be placed on the lift truck and/or base frame.

In an exemplary embodiment, the handling system and/or the lift truck may have a device, by which a raising and/or lowering of the entire truck and/or the base frame between the individual rail bundles of guide rails in the floor may be implemented.

The charging top part and/or the charging device may be stored at one of the charging stations or at another suitable storage location, and, if required, are coupled to the handling system. This may be effected, for example, by driving under the top part and/or the support element with subsequent lifting by the handling system. The lifting of the batch may be effected with the handling system. This may mean, for example, that the charging top part itself may not have to have its own lifting device. According to an exemplary embodiment, the load bearing of the support element may be effected using forks (i.e. using the rods of the rod unit). For example, 4 to 7 crown stock towers (devices according to the invention) may be moved simultaneously at the base and/or at the stations.

It is pointed out that the embodiments described herein represent only a limited selection of possible embodiments of the invention. Thus, it is possible to combine the features of individual embodiments in a suitable manner, so that for the skilled person with the embodiments that are explicit herein a plurality of different embodiments are to be considered as obviously disclosed. In particular, some embodiments of the invention are described with device claims and other embodiments of the invention are described with process claims. However, it will immediately become clear to the person skilled in the art when reading this application that, unless explicitly stated otherwise, in addition to a combination of features belonging to one type of subject-matter of the invention, also any combination of features, which belong to different types of subject-matter of the invention, are also possible.

BRIEF DESCRIPTION OF THE DRAWINGS

In the following, for further explanation and better understanding of the present invention, embodiment examples are described in more detail with reference to the appended drawings, in which.

DETAILED DESCRIPTION OF EXEMPLARY EMBODIMENTS

Figure 1:
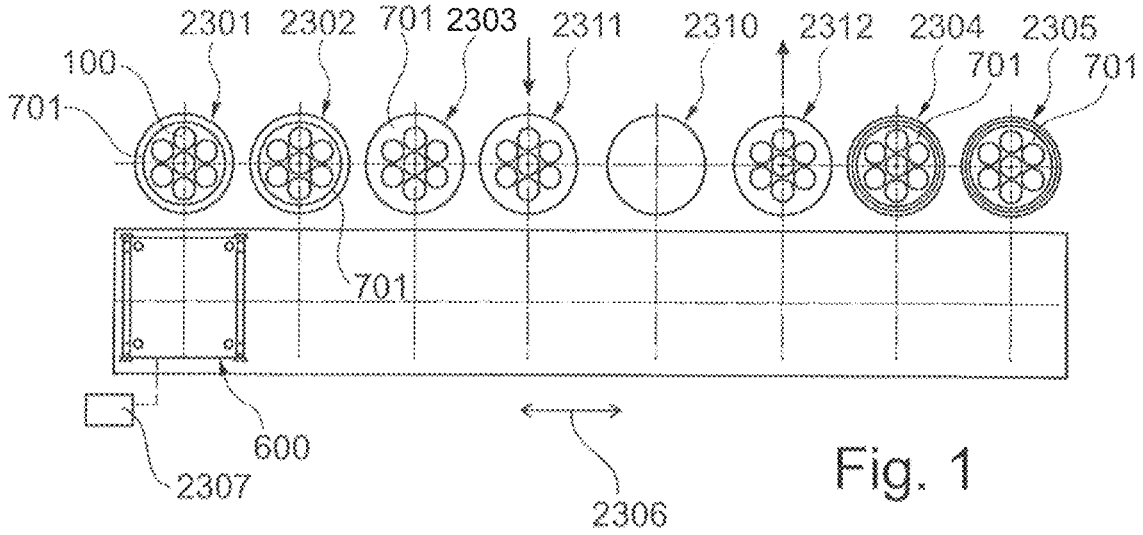
FIG. 1 to FIG. 3 show schematic representations of an arrangement having a linear apposition of temperature control stations and charging stations according to an exemplary embodiment of the present invention.

Same or similar components in different figures are provided with the same reference numerals. The representations in the figures are schematic.

Figure 2:
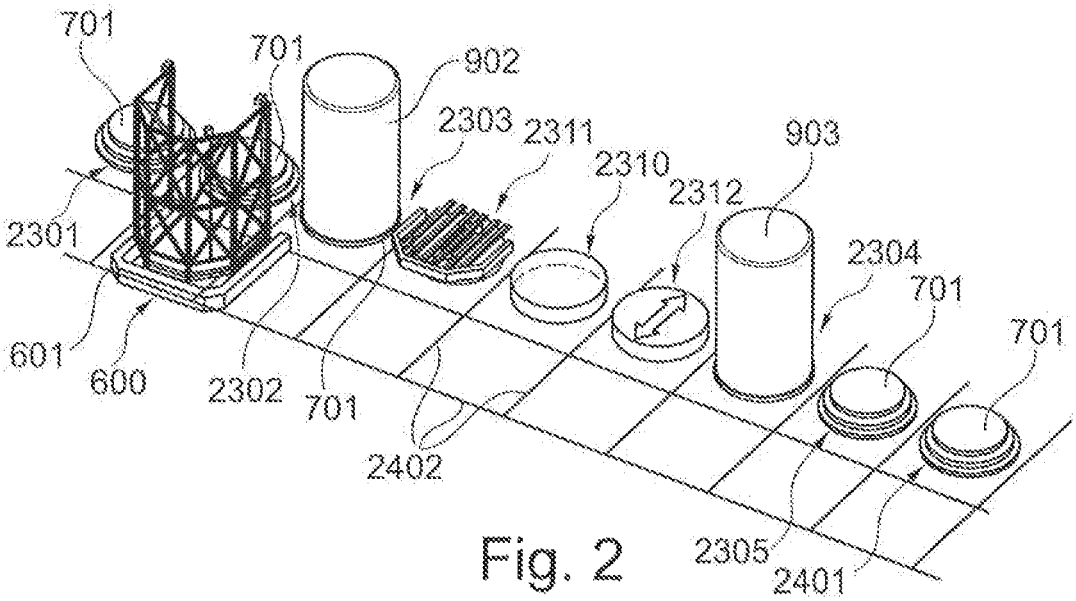
Figure 3:
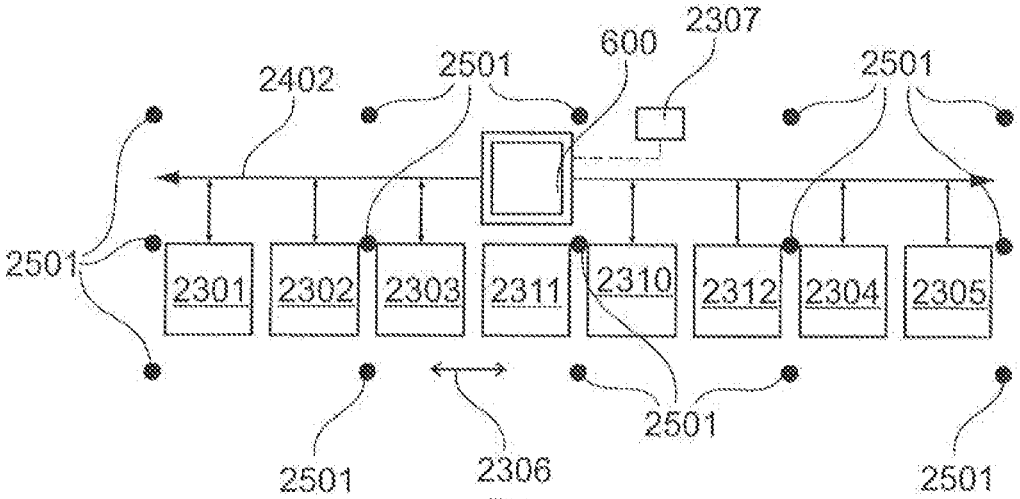

FIG. 1 to FIG. 3 show schematic representations of an arrangement having a linear apposition 2306 of temperature control stations 2301, 2302, 2303, 2304, 2305 for heat treating component parts, charging stations 2311, 2312 and a storage location 2310 according to an exemplary embodiment of the present invention. In FIG. 2, a sixth temperature control station 2401 is additionally shown.

Figure 8:
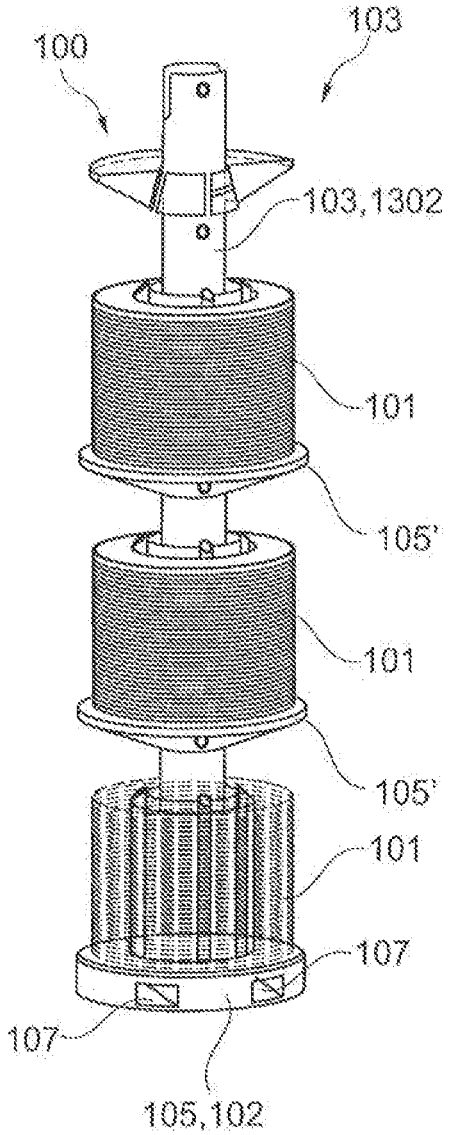
FIG. 8 shows a schematic representation of a charging device having a carrier element and/or a carrier column and a support element as a base body according to an exemplary embodiment of the present invention.

The temperature control stations 2301, 2302, 2303, 2304, 2305 each may have a temperature control device 701, in each of which a functional device may be placeable. The functional device may for example be a charging device 100 for carrying component parts 101 to be temperature-controlled, in particular a charging device as shown in FIG. 8, a guide cylinder 801 or a furnace hood 902, 903. Furthermore, the arrangement may have two charging stations 2311, 2312, on which the functional devices may be placeable. The arrangement may further have a handling system 600 for handling the functional device, wherein the handling system 600 may be configured to transport the functional device between the charging station 2311, 2312, the temperature control stations 2301, 2302, 2303, 2304, 2305, 2401 and the storage location 2310.

The temperature control stations 2301, 2302, 2303, 2304, 2305, 2401 may describe a location or station, at which a temperature control device may be provided. Herein, the temperature control stations 2301, 2302, 2303, 2304, 2305, 2401 may have at least one temperature control device 701 on which the component parts 101 to be temperature-controlled may be superimposable, in particular when they may be placed in the charging device 100. For example, in the temperature control stations 2301, 2302, 2303, 2304, 2305, 2401, corresponding furnace hoods 902, 903 of temperature control stations 701 may be placed, which together with corresponding furnace bases may thermally insulate the component parts 101 from the environment. In FIG. 2, corresponding furnace hoods 902, 903 may be arranged, respectively, at the third temperature control station 2303 and at the fourth temperature control station 2304.

In the temperature control stations 2301, 2302, 2303, 2304, 2305, 2401 the component parts 101 may be temperature-controlled, i.e. heated or actively cooled. Furthermore, the component parts may also be kept in the temperature control stations 2301, 2302, 2303, 2304, 2305, 2401 at a defined temperature for a predetermined period of time.

In the charging stations 2311, 2312, the component parts 101 may be prepared for the temperature control stations 2301, 2302, 2303, 2304, 2305, 2401 and may be charged accordingly. For example, the above described support elements 105 and carrier elements 103 of the device 100 may be placed on a charging station 2311, and equipped with the component parts 101. For example, the fastening device 602 of the handling system may grip the charging device 100 and/or the gripper frame 1702 from the charging station 2311, and may feed them to a corresponding temperature control station 2301, 2302, 2303, 2304, 2305, 2401.

Furthermore, the arrangement may have a storage station 2310, at which the handling system 600 and/or the functional device may be storable. The storage station 2310 may thus form a placeholder between the temperature control stations 2301, 2302, 2303, 2304, 2305, 2401 and the charging stations 2311, 2312. For example, a batch of component parts 101 that may already be temperature-controlled may be stored on the storage station 2310, while the handling system 600 may already convey further functional units, such as for example a further batch of component parts 101 to be temperature-controlled or a furnace hood 902, 903. Furthermore, furnace hoods 902, 903 of a temperature control station 2301, 2302, 2303, 2304, 2305, 2401 may be stored in order to enable the handling and the access to component parts 101 in this temperature control station 2301, 2302, 2303, 2304, 2305, 2401.

The handling system 600 may convey a batch of component parts 101 to a temperature control station 2301, 2302, 2303, 2304, 2305, 2401, while a further batch of component parts 101 may already be being prepared on the charging station 2311, 2312. While the one batch of component parts 101 may be temperature-controlled in a temperature control station 2301, 2302, 2303, 2304, 2305, 2401, temperature-controlled component parts may be conveyed to the other temperature control station 2301, 2302, 2303, 2304, 2305, 2401 or may be fed to this further temperature control station 2301, 2302, 2303, 2304, 2305, 2401. It may also be possible that the handling system 600 also lifts and conveys the furnace hoods 901, 902 of the respective temperature control station 2301, 2302, 2303, 2304, 2305, 2401 (see FIG. 8 to FIG. 12) in order to ensure the access to the temperature-controlled component parts 101 and/or the temperature control device of the temperature control station 2301, 2302, 2303, 2304, 2305, 2401.

In FIG. 2 and FIG. 3, an exemplary drive system for the handling system 600 is also shown. The transport device of the handling system 600 may have a rail guide element and guide rails 2402. The guide rails 2402 may be fixable on a floor, wherein the rail guide element may be coupled to the base frame 601 and may be coupleable to the guide rails 2402 in such a way that the base frame 601 may be movable along the guide rails 2402. The guide rails 2402 may, for example, be embedded and/or fixed in a floor, and may lead (or guide) in a desired moving direction of the transport device 600. The rail guide element may, for example, have a rubber wheel or a metal wheel, which may be detachably coupled to the guide rails 2402 and may be movable along the guide rails 2402.

The handling system 600 may be configured, for example, movably parallel to the linear apposition 2306.

The charging stations 2311, 2312 may also be embodied movably, and/or a movable base body 102 may be placed at a charging station 2311, 2312, on which [base body] a plurality of charged component parts 101 may already be placed, in particular on corresponding carrier elements 103 and/or support elements 105 (see FIG. 1, FIG. 16). Thus a base body 102 that may be equipped with a plurality of carrier elements 103 may be moved to the charging station 2311, 2312, wherein subsequently the handling system 600 may pick up the base body 102 and/or the plurality of support elements 105, and may move on to the corresponding temperature control stations 2301, 2302, 2303, 2304, 2305, 2401.

Furthermore, a control unit 2307 may be coupled to the handling system 600, the temperature control stations 2301, 2302, 2303, 2304, 2305, 2401 and the charging stations 2311, 2312. The control unit 2307 may be configured to automatically control the handling system 600, the temperature control stations 2301, 2302, 2303, 2304, 2305, 2401, and the charging stations 2311, 2312. The arrangement may be operated automatically by the control unit 2307 in such a way that the handling system 600 may be moved, in particular based on control programs, and the temperature control devices may be operated automatically at the temperature control stations 2301, 2302, 2303, 2304, 2305, 2401.

In FIG. 3, movement directions of the handling system 600 are further represented by the movement arrows. The handling system 600 may, for example, be moved in parallel along the linear apposition 2306 of the individual stations 2301, 2302, 2303, 2304, 2305, 2310, 2311, 2312, 2401 and may, at one of a predetermined position equip or unload the respective station 2301, 2302, 2303, 2304, 2305, 2310, 2311, 2312, 2401 by the handling system 600 being extendable in the direction of the respective station.

Furthermore, in FIG. 3, hall supports 2501 are represented. The hall supports 2501 may, for example, be arranged between two adjacent stations 2301, 2302, 2303, 2304, 2305, 2310, 2311, 2312, 2401. The distribution of the hall supports 2501 may allow that the arrangement may be set up in a statically simple and robust hall. Correspondingly, a required hall area may be saved.

Figure 4:
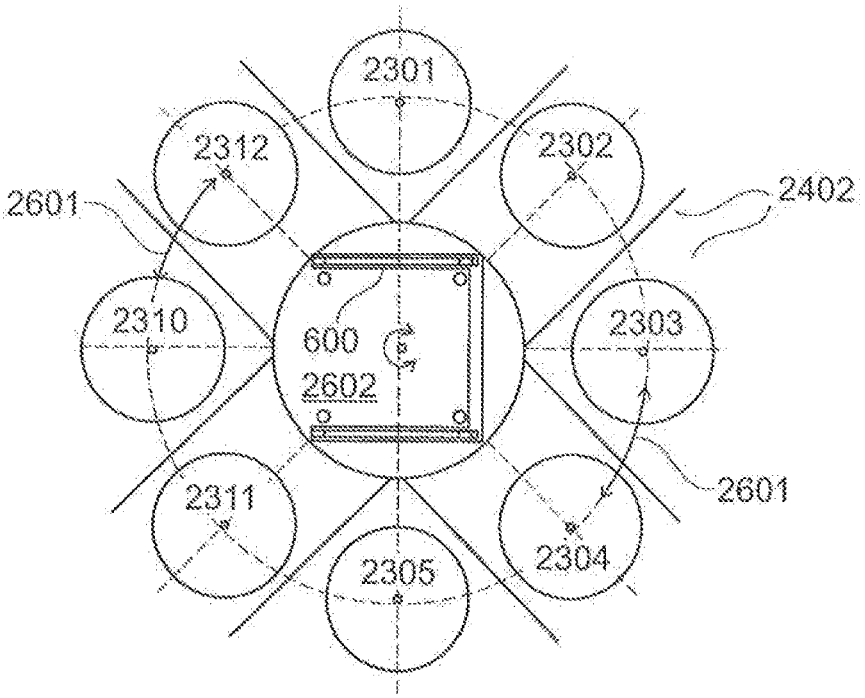
FIG. 4 to FIG. 6 show schematic representations of an arrangement having a circular apposition of temperature control stations and charging stations according to an exemplary embodiment of the present invention.
Figure 5:
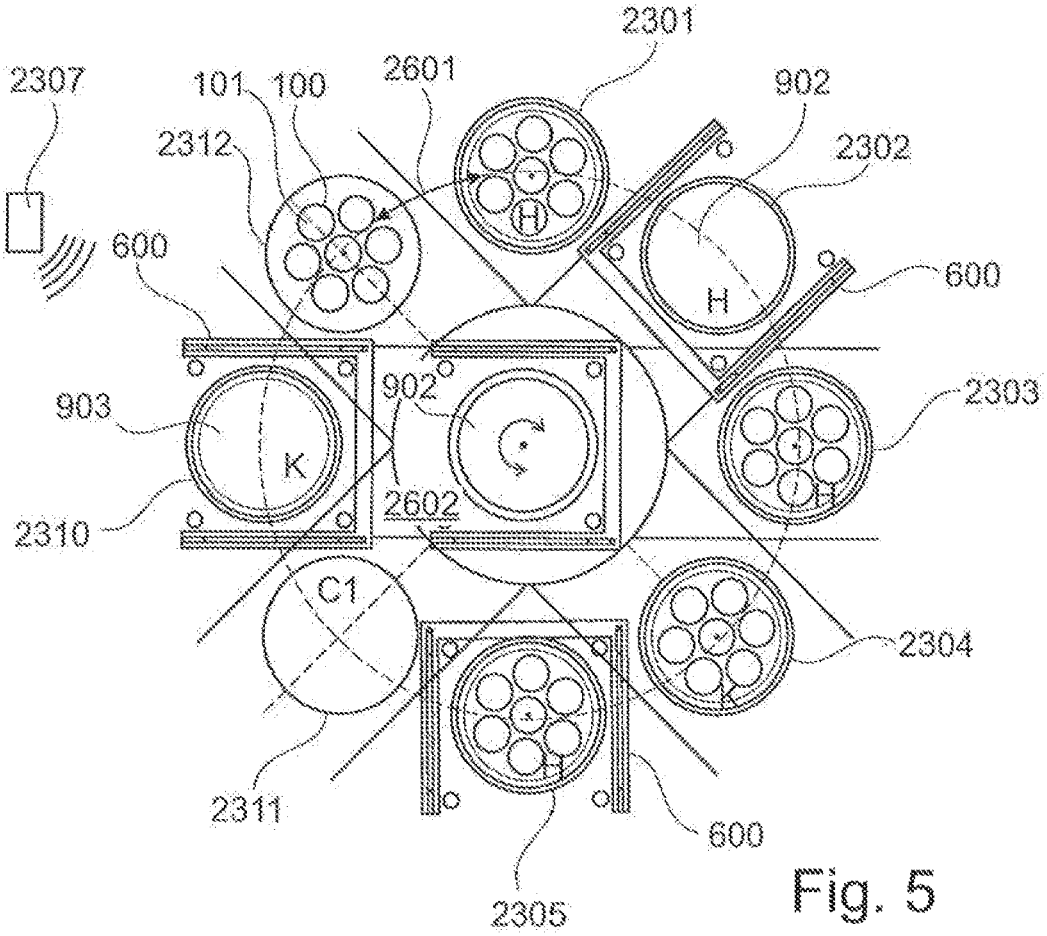
Figure 6:
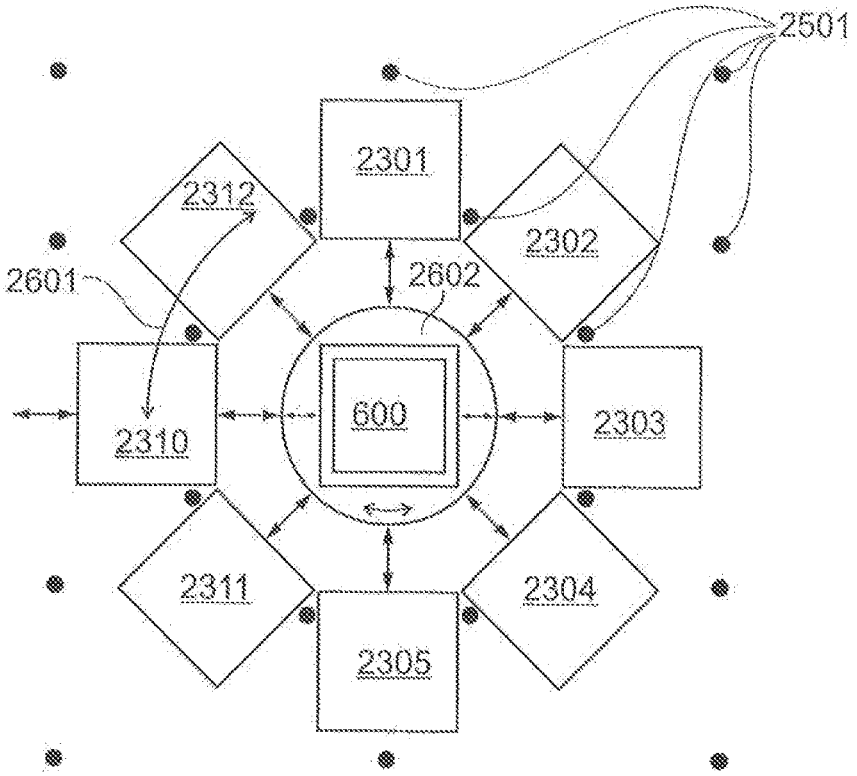

FIG. 4 to FIG. 6 show schematic representations of an arrangement having a circular apposition (or circular arrangement) 2601 of temperature control stations 2301, 2302, 2303, 2304, 2305, a storage station 2310, and charging stations 2311, 2312, according to an exemplary embodiment of the present invention. The handling system 600 may be arranged in the center of the circular apposition 2601. According to the circular apposition 2601, the centers and/or the center points of the respective stations (temperature control stations 2301, 2302, 2303, 2304, 2305, storage station 2310 and charging stations 2311, 2312) may be arranged along an imaginary circle spaced at a distance from each other.

With the circular apposition, the temperature control stations 2301, 2302, 2303, 2304, 2305, the storage station 2310 and the charging stations 2311, 2312 may be placed closely together around the handling system 600. The handling system 600 may thus reach each station 2301, 2302, 2303, 2304, 2305, 2310, 2311, 2312 in a short distance. The handling system 600 may rotate and, due to the rotation of its orientation, may adjust to a desired station 2301, 2302, 2303, 2304, 2305, 2310, 2311, 2312. Subsequently, the handling system 600 may, for example with its base frame 601 and/or the gripper frame 1702, be extended translationally from the center in the direction of the respective station 2301, 2302, 2303, 2304, 2305, 2310, 2311, 2312 in order to place or remove the corresponding functional devices, such as for example the charged component parts 101 or the furnace hoods 902, 903.

In the exemplary embodiment, the arrangement may have a rotary table (or turntable) 2602, which may be arranged on a floor in the center of the circular apposition 2601. The handling system 600 in the center on the rotary table 2602 may be placed in such a way that by rotating the rotary table 2602 the handling system 600 may be rotatable in its orientation. For example, guide rails may be formed on the rotary table 2602, into which the rail guide elements of the base frame 601 may be coupled. When the rotary table 2602 is in a desired rotational position, the guide rails of the rotary table 2602 may be aligned accordingly with the guide rails 2402 in the floor so that the base frame 601 may be moved along the guide rails of the rotary table 2602 and the guide rails 2402 in the floor, which may lead towards the desired station 2301, 2302, 2303, 2304, 2305, 2310, 2311, 2312.

In FIG. 5, plural operating positions of the handling system 600 are shown by way of example. In one operating position, the rotary table 2602 may be aligned in the direction of the second temperature control station 2302. The first temperature control station 2301, the second temperature control station 2302, the third temperature control station 2303 as well as the fifth temperature control station 2305 may, for example, be in the operating mode "heating" H and heat a batch of component parts 101. The base frame 601 of the handling system 600 may be extended from the rotary table 2602 in the direction of the second temperature control station 2302 and may partially surround the second temperature control station 2302. In this position, the handling system 600 may, for example, lift and convey a furnace hood 902.

The rotary table 2602 may also be rotated further, so that in a further operating position the handling system 600 may, for example, enclose the fifth temperature control station 2305, and accordingly may handle a furnace hood 902, 903 or a batch of component parts 101.

Furthermore, a further operating position is shown, in which the handling system 600 may place a furnace hood 903 on the storage location 2310. The furnace hood 903 may be stored at storage location 2310 until a further use may be planned.

Furthermore, in FIG. 5, the charging device 100, for example from FIG. 8, may be represented on the second charging station 2312, on which a plurality of component parts 101, such as wire bundles, may be combined to form a batch. The entire batch may be picked up by the handling system 600 and placed at one of the temperature control stations 2301, 2302, 2303, 2304, 2305 for temperature-controlling. In this respect, it is shown by way of example that the process step of cooling K of a batch of component parts 101 may be carried out in the fourth temperature control station 2304. Each individual temperature control station 2301, 2302, 2303, 2304, 2305 may, for example, be used for cooling K or for heating H of the component parts 101, and may be equipped with appropriate heating hoods or cooling hoods.

As shown in FIG. 5, a plurality of corresponding stations 2301, 2302, 2303, 2304, 2305, 2310, 2311, 2312 may be served and operated in a very small space with one handling system 600. With the control unit 2307, a fully automatic operation of the handling system 600 as well as of the plurality of stations 2301, 2302, 2303, 2304, 2305, 2310, 2311, 2312 may be carried out.

In FIG. 6, the directions of movement of the handling system 600 are represented by way of example. Furthermore, a plurality of hall supports 2501 is represented. For example, hall supports 2501 may be arranged along the circular apposition 2601, so that a statically stable large-area hall may be provided for arranging the arrangement in a simple and robust manner.

Figure 7:
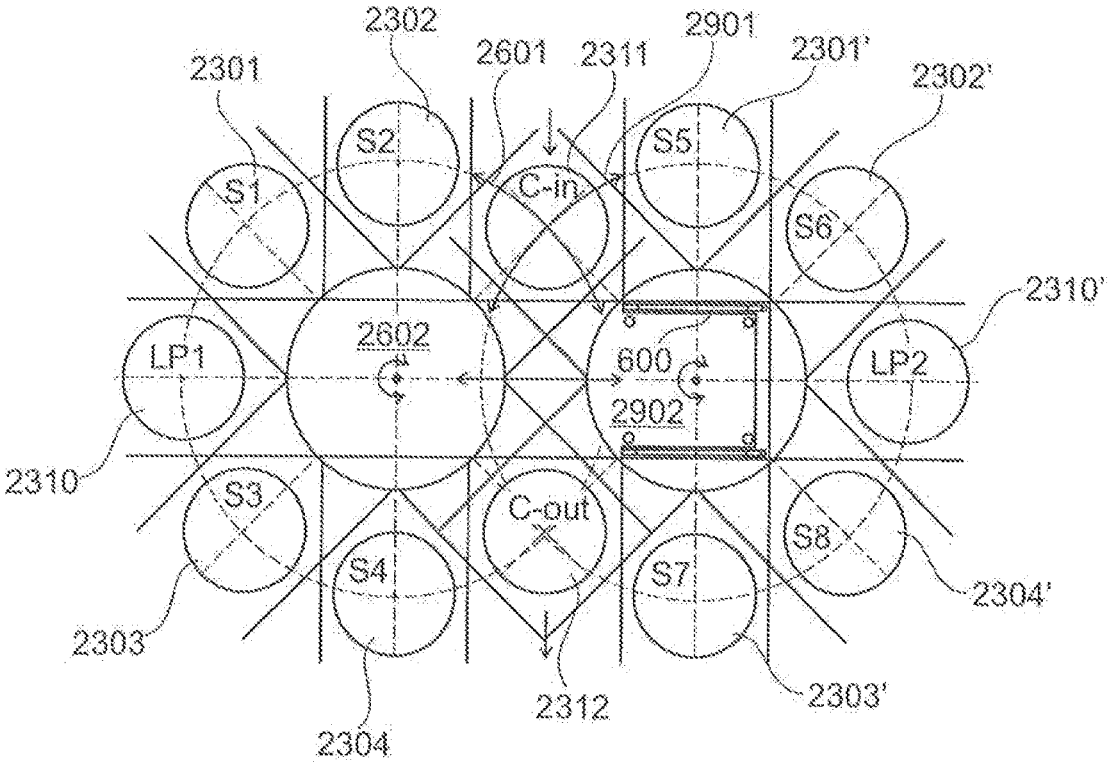
FIG. 7 shows a schematic representation of an arrangement having a circular apposition and a further circular apposition of temperature control stations and charging stations according to an exemplary embodiment of the present invention.

FIG. 7 shows a schematic representation of an arrangement having a circular apposition 2601 and another circular apposition 2901 of temperature control stations 2301, 2302, 2303, 2304, 2305, charging stations 2311, 2312, and storage stations 2310 according to an exemplary embodiment of the present invention.

A first group of the temperature control stations 2301, 2302, 2303, 2304, 2305, the storage station 2310 and the charging stations 2311, 2312 may be arranged side by side along the circular apposition 2601, wherein a second group of the temperature control stations 2301', 2302', 2303', 2304', 2305' and the storage station 2310' may be arranged side by side along a further circular apposition 2901. The circular apposition 2601 and the further circular apposition 2901 may overlap, wherein the handling system 600 may be arranged in such a way that the handling system 600 may be movable, in particular linearly, between the center of the circular apposition 2601 and a further center of the further circular apposition 2901.

Both circular appositions 2601, 2901 may overlap and may each have spaced centers from which the handling system 600 may serve the respective group of stations. The two circular appositions 2601, 2901 may have, at a common position between their stations, a gap and/or a distance, through which the handling system 600 may be movable between the centers.

The arrangement may have a further rotary table 2902, which may be arranged on a floor in the further center of the further circular apposition 2901. With the configuration shown in FIG. 7, a plurality of temperature control stations (S1 to S8) may be operated in a heating mode or a cooling mode independently of each other. Furthermore, for example, the charging station 2311 (C-in) may represent the input of a batch of component parts 101, which may subsequently be conveyed on by the handling system 600. Furthermore, for example, the charging station 2312 (C-out) may represent the output of a batch of component parts 101, wherein readily temperature-controlled batches of component parts 101 may be placed on the charging station 2312 and may be transported away for further processing.

Batches of component parts 101 or furnace hoods 902, 903 may be temporarily stored on the storage locations 2310, 2310' (LP1, LP2).

FIG. 8 shows a schematic representation of a charging device 100 having a carrier element 103 and/or carrier beam 1302 and a support element 105 as a base body 102 according to an exemplary embodiment of the present invention.

The component parts 101 may consist, for example, of coiled metal strips and/or metal wires. These may also be slipped over the carrier beam 1302 and may rest accordingly on a support element 105, 105'.

The lowest support element 105 may further have engagement openings 107, in which gripping elements (e.g. the rods of the rod unit 1703 from FIG. 9) may engage in order to raise and lower the support element 105. By lifting and lowering the support element 105, the component parts 101 may be handled accordingly.

Figure 9:
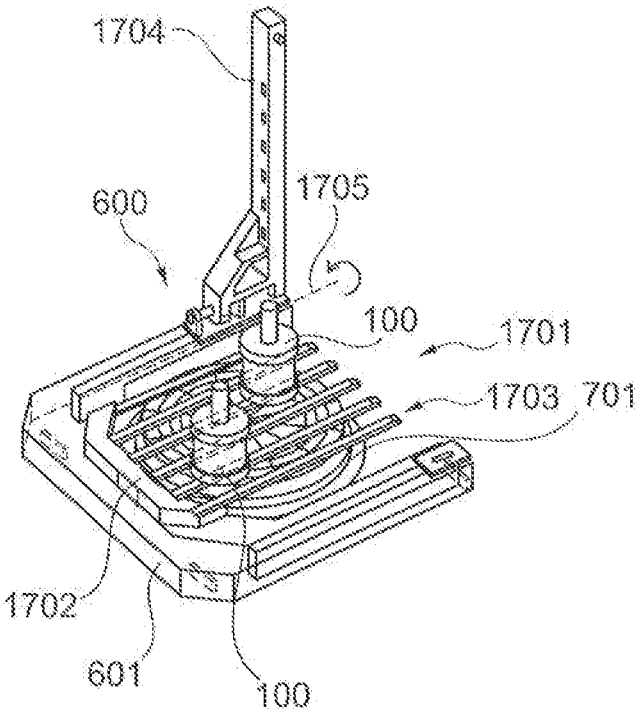
FIGS. 9 and 10 show schematic representations of a handling system having a gripper unit according to an exemplary embodiment of the present invention.
Figure 10:
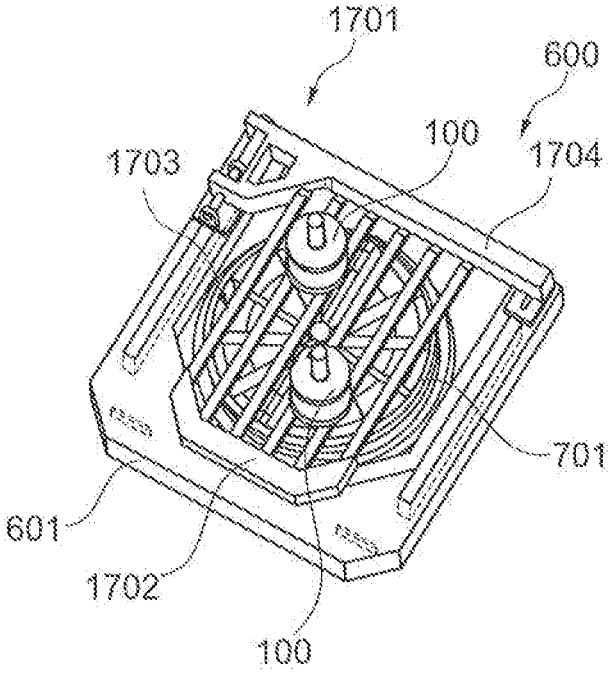

FIG. 9 and FIG. 10 show schematic representations of a handling system 600 having a gripper unit 1701.

For example, the individual charging devices 100, on which the component parts 101 may be stored, may be pushed on the rods of the rod unit 1703. Herein, for example, the engagement openings 107 may serve as the support element 105. The charging devices 100 may be placed, for example, on the charging station 2311, 2312 in such a way that parallel aligned rods of the rod unit 1703 may move in a plurality of charging devices in order to thus transport plural charging devices 100.

The rod unit 1703 may be embodied to be movable relative to the gripper frame 1702 and may be moved, for example, in the direction of the support elements 105. Furthermore, the rod unit 1703 together with the gripper frame 1702 may be embodied movably relative to the base frame 601, which may be embodied movably along the floor. Thus, the gripper frame 1702 with the rod unit 1703 may be moved relatively into and out of the base frame 601 in order to grip the support elements 105, on which the component parts 101 may be stored.

The gripper frame 1702 may be selectively coupled to the base frame 602. For example, a coupling device and/or fastening device 602 may be provided at the base frame 602, which may selectively couple the base frame in order to subsequently transport it.

After the moving in (or retracting) of the rods of the rod unit 1703, the gripper frame 1702 or the base frame 601 of the handling system 600 may be raised or lowered in order to transport the support elements 105 together with the component parts 101 to the desired stations. For reinforcement of the base frame 601, a reinforcing beam 1704 may be provided, which may be rotatable around a rotation axis 1705. In FIG. 9, the reinforcing beam 1704 may be in an opened position so that the charging devices 100 may be released, and in FIG. 10 the reinforcing beam 1704 may be in a closed position. The rods of the rod unit 1703 may be coupled to the reinforcement beam 1704 in order to form a reinforced structure and transport the charging devices 100.

Figure 11:
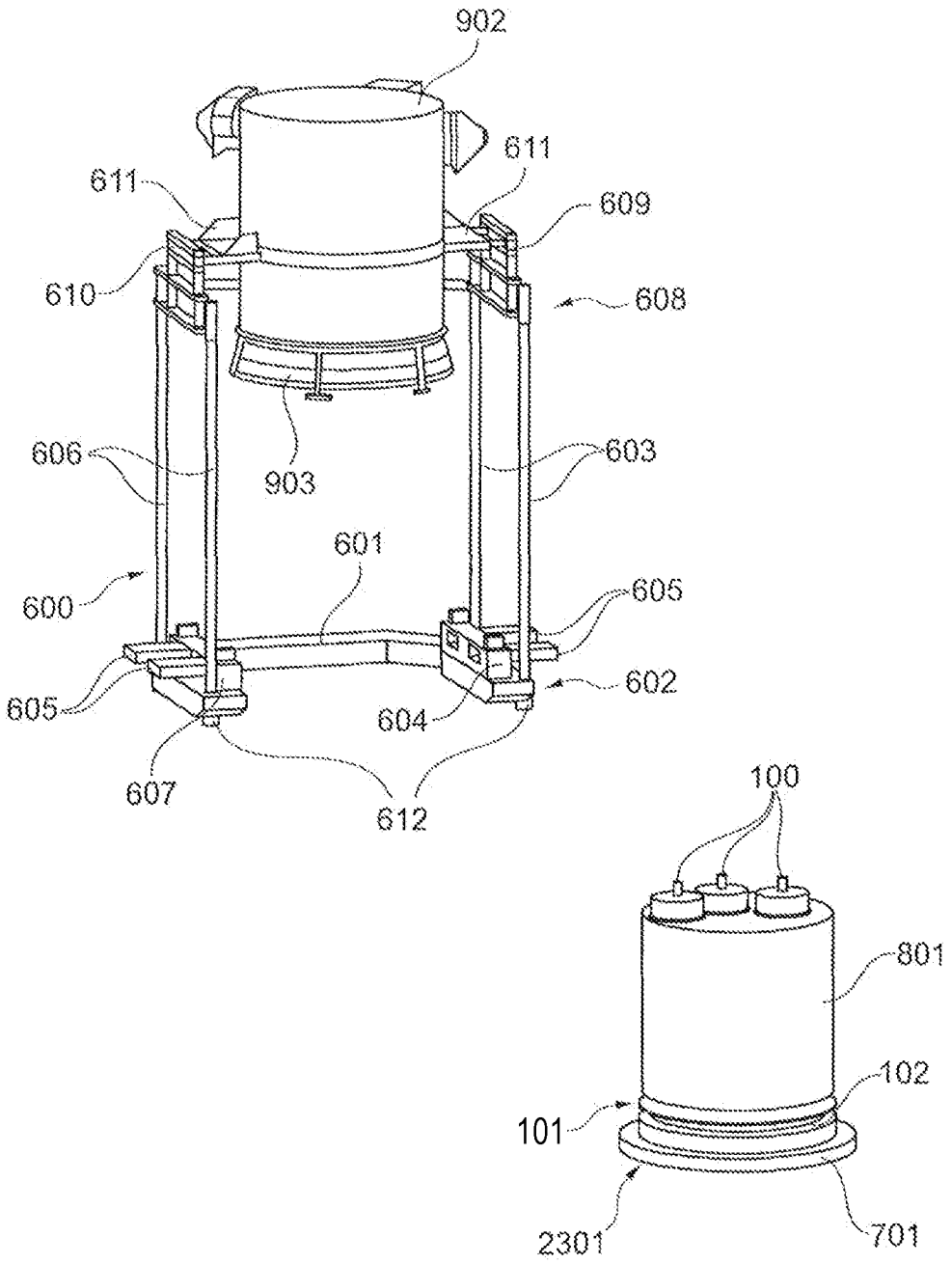
FIG. 11 shows a schematic representation of a handling system having fastening devices for gripping furnace hoods according to an exemplary embodiment of the present invention.

FIG. 11 shows a handling system 600 for handling a functional device. The transport device may have a base frame 601, which may be transportable along a floor, and a fastening device 602, which may be coupled to the base frame 601. The fastening device 602 may be configured to selectively fasten the functional device to the base frame 601. The base frame 601 may be configured in such a way that the base frame 601 may be transportable for transporting the functional device between a set-up location (e.g. the charging stations 2311, 2312 or the storage location 2310), at which the functional device may be selectively fastenable to the base frame 601, and a tempering location in the temperature control device 701 at the temperature control stations 2301, 2302, 2303, 2304, 2305, 2401.

A functional device may represent the charging device 100 for carrying component parts 101 to be temperature-controlled, a guide cylinder 801, or a furnace hood 902, 903. In a hood-type furnace used as a temperature control device 701, for example, a plurality of different furnace hoods 902, 903 may be placed one above the other. For example, a furnace hood 903 with a larger diameter may be placed over a furnace hood 902 with a smaller diameter so that the smaller furnace hood 902 may be located inside the larger furnace hood 903. Herein, the innermost furnace hood 902 may, for example, act as a protective hood so that a protective gas atmosphere may be formed in an inner annealing chamber. Another furnace hood 903, such as a heating hood or a cooling hood, may be placed over the protective hood 902.

The base frame 601 may be formed along a base plane, wherein the fastening device 602 may be movable perpendicular to the base plane. The transport device may have at least one first guide structure 603, which may be fixed to the base frame 601 and may extend (at least with a directional component) perpendicular to the base plane. The fastening device 602 may have a first guide carriage 604, which may be movably coupled to the first guide structure 603. The first guide carriage 604 may selectively be coupleable to the functional device.

The first guide structure 603 may consist, for example, of one or more beams (or carriers, or girders) (steel beams) which may be fixed to the base frame 601. For example, the beams may simultaneously form guide rails for the first guide carriage 604. For example, the first guide carriage 604 may be moved along a column as a beam. In particular, two spaced beams of the first guide structure 603 may be provided, at which the first guide carriage 604 may be movably arranged.

The first guide carriage 604 may have a controllable fastening element 605, in particular a clamping jaw. The controllable fastening element 605 may be adjustable into a release position, in which the functional device may be decoupled from the controllable fastening element 605, and may be adjustable into a clamping position, in which the functional device may be coupled to the controllable fastening element 605. The controllable fastening element 605 may, for example, be a movable clamping jaw or an operable gripping element in order to implement a selective coupling with the functional unit.

The second guide structure 606 described in the following may be embodied according to the first guide structure 603 described above. Accordingly, the further first guide carriages 609, second guide carriage 607 and further second guide carriages 610 described below may be configured to correspond to the first guide carriage 603 described above.

The second guide structure 606 may also be fixed to the base frame 601 and may extend perpendicular to the base plane. The fastening device 602 may have a second guide carriage 607, which may be movably coupled to the second guide structure 606. The second guide carriage 607 may be selectively coupleable to the functional device, wherein the first guide carriage 604 and the second guide carriage 607 may be arranged in such a way that the guide carriages 604, 607 may be opposite to each other with respect to the functional device.

Furthermore, a further fastening device 608 may be provided, which may be movable perpendicular to the base plane. The fastening device 602 and the further fastening device 608 may thus be arranged one after the other or one above the other along a direction perpendicular to the base plane. In particular, the fastening device 602 and the further fastening device 608 may be moved relative to each other.

The further fastening device 608 may have a further first guide carriage 609, which may be movably coupled to the first guide structure 603, wherein the further first guide carriage 609 may be selectively coupleable to the functional device or to a further functional device. The further fastening device 608 may have a further second guide carriage 610, which may be movably coupled to the second guide structure 607. The further second guide carriage 607 may be selectively coupleable to the functional device or to the further functional device. The further first guide carriage 609 and the further second guide carriage 610 may be arranged in such a way that the further guide carriages 609, 610 may be opposite to each other with respect to the functional device.

The further first guide carriage 609 and the further second guide carriage 610 may be coupled to each other, for example by reinforcing struts. Thus, the further fastening device 608 and/or the first guide structure 603 and the second guide structure 606 may be stiffened and/or reinforced.

Furthermore, roller elements 612 may be arranged at the base frame 601. The roller elements 612 may serve for moving the base frame 601 along the floor. Accordingly, a coupling with guide rails 2401 may be provided.

Supplementarily, it is noted that "having" does not exclude other elements or steps and "a" or "an" does not exclude a plurality. Furthermore, it should be noted that features or steps, which have been described with reference to one of the above embodiment examples, can also be used in combination with other features or steps of other embodiment examples, which have been described above. Reference numerals in the claims are not to be considered as a limitation.

| List of reference numerals: | |
|---|---|
| 100 | charging device |
| 101 | component part |
| 102 | base body |
| 103 | carrier element |
| 105 | support element |
| 107 | engagement opening |
| 600 | handling system |
| 601 | base frame |
| 602 | fastening device |
| 603 | first guide structure |
| 604 | first guide carriage |
| 605 | controllable fastening element |
| 606 | second guide structure |
| 607 | second guide carriage |
| 608 | further fastening device |
| 609 | further first guide carriage |
| 610 | further second guide carriage |
| 611 | additional fastening element |
| 612 | roller element |
| 701 | temperature control device |
| 801 | guide cylinder |
| 902 | furnace hood |
| 903 | further furnace hood |
| 1302 | support beam |
| 1701 | gripper unit |
| 1702 | gripper frame |
| 1703 | rod unit |
| 1704 | reinforcing beam |
| 1705 | axis of rotation |
| 2301 | first temperature control station |
| 2302 | second temperature control station |
| 2303 | third temperature control station |
| 2304 | fourth temperature control station |
| 2305 | fifth temperature control station |
| 2306 | linear apposition |
| 2307 | control unit |
| 2310 | storage location |
| 2311 | first charging station |
| 2312 | second charging station |
| 2401 | sixth temperature control station |
| 2402 | guide rails |
| 2501 | hall support |
| 2601 | circular apposition |
| 2602 | rotary table |
| 2901 | further circular apposition |
| 2902 | further rotary table |

The invention claimed is:

1. Arrangement for heat treating component parts, the arrangement having:

a first stationary furnace for heat treating component parts, a second stationary furnace for heat treating component parts, wherein the first stationary furnace and the second stationary furnace each have a temperature control device for heat treating the component parts, and a functional device positioned on the temperature control device, wherein the functional device is a charging device for carrying component parts to be temperature-controlled or a guide cylinder or a furnace hood of the temperature control device, a charging station, on which the functional device is positioned, and a handling system for handling the functional device, wherein the handling system is configured to convey the functional device between the charging station, the first stationary furnace and the second stationary furnace, wherein the first stationary furnace and the second stationary furnace and the charging station are arranged successively along an apposition, wherein the charging station and the first stationary furnace and the second stationary furnace are arranged side by side along a circular apposition, and wherein the handling system is disposed at the center of the circular apposition.

2. Arrangement according to claim 1, further having at least one further stationary furnace for the heat treatment of component parts, wherein the further stationary furnace has a temperature control device, in which a functional device is positioned, and wherein the handling system is configured to convey the functional device between the at least one charging station and the first stationary furnace and the second stationary furnace and the further stationary furnace.

3. Arrangement according to claim 1, further having at least one further charging station, on which the functional device is positioned, wherein the handling system is configured to convey the functional device between the charging stations and the first stationary furnace and the second stationary furnace.

4. Arrangement according to claim 1, further having a storage station, at which the handling system and/or the functional device is storable, wherein the handling system is configured to convey the functional device between the storage station, the at least one charging station and the first stationary furnace and the second stationary furnace.

5. Arrangement according to claim 1, further having a rotary table, which is disposed on a floor at the center of the circular apposition, wherein the handling system is placed at the center on the rotary table in such a way that the handling system is rotatable in its orientation by rotating the rotary table.

6. Arrangement according to claim 1, wherein a first group of the at least one charging station and the first stationary furnace and the second stationary furnace are arranged side by side along the circular apposition, wherein a second group of the first stationary furnace and the second stationary furnace are arranged side by side along a further circular apposition, wherein the circular apposition and the further circular apposition overlap, and wherein the handling system is arranged in such a way that the handling system is movable between the center of the circular apposition and a further center of the further circular apposition.

7. Arrangement according to claim 6, further having a further rotary table, which is arranged on a floor in the further center of the further circular apposition, wherein the handling system is placeable in the further center on the rotary table in such a way that the handling system is rotatable in its orientation by rotating the further rotary table.

8. Arrangement according to claim 1, further having a control unit, which is coupled to the handling system, the first stationary furnace and the second stationary furnace and the at least one charging station, wherein the control unit is configured to automatically control the handling system, the first stationary furnace and the second stationary furnace and the at least one charging station.

9. Arrangement according to claim 1, wherein the handling system has a transport device having a base frame, which is transportable along a floor, and a fastening device, which is coupled to the base frame, wherein the fastening device is configured to selectively fasten the functional device to the base frame, wherein the base frame is configured such that the base frame is transportable for transporting the functional device between a set-up location, at which the functional device is selectively attachable to the base frame, and a temperature control location in the temperature control device.

10. Arrangement according to claim 9, wherein the base frame is formed along a base plane, wherein the fastening device is movable perpendicularly or parallel to the base plane;

wherein the transport device has at least one first guide structure, which is fixed to the base frame and extends perpendicular to the base plane, wherein the fastening device has a first guide carriage, which is movably coupled to the first guide structure, and wherein the first guide carriage is selectively coupleable to the functional device.

11. Arrangement according to claim 10, wherein the first guide carriage has a controllable fastening element, wherein the controllable fastening element is adjustable into a release position, in which the functional device is decoupled from the controllable fastening element, and is adjustable into a clamping position, in which the functional device is coupled to the controllable fastening element.

12. Arrangement according to claim 10, wherein the transport device has at least one second guide structure which is fixed to the base frame and extends perpendicular to the base plane, wherein the fastening device has a second guide carriage, which is movably coupled to the second guide structure, wherein the second guide carriage is selectively coupleable to the functional device, wherein the first guide carriage and the second guide carriage are arranged such that the guide carriages are opposite to each other with respect to the functional device.

13. Arrangement according to claim 10, wherein the transport device has a further fastening device, wherein the further fastening device is movable perpendicular to the base plane.

14. Arrangement according to claim 13, wherein the further fastening device has a further first guide carriage, which is movably coupled to the first guide structure, wherein the further first guide carriage is selectively coupleable to the functional device or to a further functional device.

15. Arrangement according to claim 14, wherein the further fastening device has a further second guide carriage, which is movably coupled to the second guide structure, wherein the further second guide carriage is selectively coupleable to the functional device or the further functional device, wherein the further first guide carriage and the further second guide carriage are arranged such that the further guide carriages are opposite to each other with respect to the functional device;

wherein the further functional device is selectively coupleable to the further fastening device, wherein the functional device is, by the fastening device, and the further functional device is, by the further fastening device, movable relative to each other.

16. Arrangement according to claim 10, wherein the functional device forms a gripper unit, to which a component part is selectively coupleable, wherein the gripper unit is selectively attachable to the base frame by the attachment device;

wherein the gripper unit has a gripper frame and a rod unit having a plurality of rods parallel to each other, wherein the rod unit is formed to be movable relative to the gripper frame and/or together with the gripper frame relative to the base frame in such a way that the rods are insertable into engagement openings of support elements, on which the component parts are placeable in order to transport the support elements.

17. Arrangement according to claim 9, wherein the transport device has a rail guide member and a guide rail, whereby the guide rail is fixable on a floor, wherein the rail guide member is coupled to the base frame and is coupleable to the guide rail such that the base frame is movable along the guide rail.

18. Arrangement for heat treating component parts, the arrangement having:

a first stationary furnace for heat treating component parts, a second stationary furnace for heat treating component parts, wherein the first stationary furnace and the second stationary furnace each have a temperature control device for heat treatment of the component parts, on each of which a functional device is positioned, wherein the functional device is a charging device for carrying component parts to be temperature-controlled or a guide cylinder or a furnace hood of the temperature control device, a charging station, on which the functional device is positioned, and a handling system for handling the functional device, wherein the handling system is configured to convey the functional device between the charging station, the first stationary furnace and the second stationary furnace, wherein the first stationary furnace and the second stationary furnace and the charging station are arranged successively along a linear apposition or successively along a circular apposition, wherein the handling system has a transport device having a base frame, which is transportable along a floor, and a fastening device, which is coupled to the base frame, wherein the fastening device is configured to selectively fasten the functional device to the base frame, and wherein the base frame is configured such that the base frame is transportable for transporting the functional device between a set-up location, at which the functional device is selectively attachable to the base frame, and a temperature control location in the temperature control device.

19. Arrangement for heat treating component parts, the arrangement having:

a first stationary furnace for heat treating component parts, a second stationary furnace for heat treating component parts, wherein the first stationary furnace and the second stationary furnace each have a temperature control device for heat treating the component parts, and a functional device positioned on the temperature control device, wherein the functional device is a charging device for carrying component parts to be temperature-controlled or a guide cylinder or a furnace hood of the temperature control device, a charging station, on which the functional device is positioned, and a handling system for handling the functional device, wherein the handling system is configured to convey the functional device between the charging station, the first stationary furnace and the second stationary furnace, wherein the first stationary furnace and the second stationary furnace and the charging station are arranged successively along a linear apposition or successively along a circular apposition, wherein the handling system has a transport device having a base frame, which is transportable along a floor, and a fastening device, which is coupled to the base frame, wherein the fastening device is configured to selectively fasten the functional device to the base frame, wherein the base frame is configured such that the base frame is transportable for transporting the functional device between a set-up location, at which the functional device is selectively attachable to the base frame, and a temperature control location in the temperature control device, wherein the base frame is formed along a base plane, wherein the fastening device is movable perpendicularly or parallel to the base plane;

wherein the transport device has at least one first guide structure, which is fixed to the base frame and extends perpendicular to the base plane, wherein the fastening device has a first guide carriage, which is movably coupled to the first guide structure, wherein the first guide carriage is selectively coupleable to the functional device, wherein the functional device forms a gripper unit, to which a component part is selectively coupleable, wherein the gripper unit is selectively attachable to the base frame by the attachment device;

wherein the gripper unit has a gripper frame and a rod unit having a plurality of rods parallel to each other, wherein the rod unit is formed to be movable relative to the gripper frame and/or together with the gripper frame relative to the base frame in such a way that the rods are insertable into engagement openings of support elements, on which the component parts are placeable in order to transport the support elements.

20. Arrangement for heat treating component parts, the arrangement having:

a first stationary furnace for heat treating component parts, a second stationary furnace for heat treating component parts, wherein the first stationary furnace and the second stationary furnace each have a temperature control device for heat treating the component parts, and a functional device positioned on the temperature control device, wherein the functional device is a charging device for carrying component parts to be temperature-controlled or a guide cylinder or a furnace hood of the temperature control device, a charging station, on which the functional device is positioned, and a handling system for handling the functional device, wherein the handling system is configured to convey the functional device between the charging station, the first stationary furnace and the second stationary furnace, wherein the first stationary furnace and the second stationary furnace and the charging station are arranged successively along a linear apposition or successively along a circular apposition, wherein the handling system has a transport device having a base frame, which is transportable along a floor, and a fastening device, which is coupled to the base frame, wherein the fastening device is configured to selectively fasten the functional device to the base frame, wherein the base frame is configured such that the base frame is transportable for transporting the functional device between a set-up location, at which the functional device is selectively attachable to the base frame, and a temperature control location in the temperature control device, wherein the transport device has a rail guide member and a guide rail, whereby the guide rail is fixable on a floor, wherein the rail guide member is coupled to the base frame and is coupleable to the guide rail such that the base frame is movable along the guide rail.

* * * * *